US005397127A

United States Patent [19]

Kawada et al.

[11] Patent Number: 5,397,127

[45] Date of Patent: Mar. 14, 1995

[54] WOOD TYPE GOLF CLUB HEAD

[75] Inventors: Kazuo Kawada; Toshihiro Horiba; Tadashi Miura, all of Hiratsuka, Japan

[73] Assignee: The Yokohama Rubber Co., Ltd., Tokyo, Japan

[21] Appl. No.: 225,693

[22] Filed: Apr. 11, 1994

[30] Foreign Application Priority Data

Apr. 12, 1993 [JP] Japan ..... 5-18289 U

[51] Int. Cl.[6] ..... A63B 53/04

[52] U.S. Cl. ..... 273/167 R

[58] Field of Search ..... 273/167 R, 169

[56] References Cited

U.S. PATENT DOCUMENTS 5,078,400 1/1992 Desboilles et al. ..... 273/167 F 5,271,620 12/1993 Moriguchi et al. ..... 273/167 F

FOREIGN PATENT DOCUMENTS 157374 10/1982 Japan .

*Primary Examiner*—William H. Grieb

*Attorney, Agent, or Firm*—Finnegan, Henderson, Farabow, Garrett & Dunner

[57] ABSTRACT

A wood type golf club head having a crown portion in an upper part of a club head body, a sole in a lower part thereof, a face in a front side thereof, a side portion between the crown portion and sole, and a continuous ridgeline X extending from a toe side to a heel side along a boundary between the crown portion and side portion, characterized in that a height of a portion Xa of the ridgeline X on the rear side is set less than $\frac{1}{4}$ of that H of the club head, a height of a portion Xb of the ridgeline X on the heel side being set more than $\frac{1}{2}$ of that H of the club head, a height of remaining portions Xc, Xd of the ridgeline X being set $\frac{1}{4}$-$\frac{1}{2}$ of that H of the club head with a total length of the last-mentioned portions Xc, Xd of the ridgeline X accounting for 60-90% of a total length of a whole ridgeline X.

5 Claims, 2 Drawing Sheets

WOOD TYPE GOLF CLUB HEAD

BACKGROUND OF THE INVENTION

This invention relates to a wood type golf club head, and more particularly to a wood type golf club head having a lower center of gravity and a sweet spot set in the central portion of a face.

For example, as shown in FIG. 6, a club head 11 of a wood type golf club called a driver is formed so as to have a crown portion 11*a* at the upper side, a sole plate 13 at a sole 12, a ball striking face 14 at the front side, and a shaft-connecting hosel 15 at a heel side. A side portion 11*b* having an inclined surface is formed so as to extend between the crown portion 11*a* and sole 12 from the toe side to the heel side via the rear side of the club head, and a continuous ridgeline X is formed along the boundary between the side portion 11*b* and crown portion 11*a*. In the club head 11 of such construction, the height of the ridgeline X measured from the sole 12 according to conventional techniques is generally over ½ of the height H of the club head. Therefore, a center of gravity of the club head is in a high position, and it becomes difficult to strike a ball high to get a long distance. Moreover, it is also difficult to give full swing to this club head smoothly.

The Position of a sweet spot on the front face 14 which is defined as a point at which a line drawn from the center of gravity of the club head perpendicularly with respect to the face 14 crosses the face 14 also becomes high, so that the sweet spot practically deviates from a meeting spot at which a ball is hit by the club head. As a result, the agreement of the sweet spot and meeting spot with each other on the face 14, which is said to enable the distance of flight of a golf ball to increase to a maximum level, becomes difficult.

In a conventional wood type golf club, the position of center of gravity of the club head 11 is controlled by burying a heavy member in the inner portion thereof or pasting a heavy member on the sole plate 13 so as to overcome this difficulty, whereby the center of gravity of the club head is lowered. However, these techniques constitute the regulation of the weight of a part of the club head 11, so that the weight of the club head becomes unbalanced, this making it difficult to swing the club head easily.

As measures for solving this problem, there is a proposal, which is disclosed in, for example, Japanese Utility Model Laid-Open No. 157374/1982, for providing a ridgeline between the crown portion and side portion of a club head in the position which has a height smaller than ½ of that of the club head. This enables the center of gravity of the club head to be lowered. However, since the whole length of the ridgeline is positioned lower than ½ of the height of the club head, the sweet spot also deviates from this position in the downward direction. Therefore, it becomes difficult to align the sweet spot with the center of the front face of the club head.

Although it is demanded that the center of gravity of the club head of a wood type golf club be lowered, it is said that hitting a ball at the sweet spot stabilizes the directivity of a driven ball and enables the driven ball to fly a maximum distance. However, with this club head, it is possible to lower the center of gravity thereof but it is not easy to set a sweet spot in the central portion of the front face of the club head. Therefore, it is difficult to stabilize the directivity of a driven ball and obtain an accurate shot.

SUMMARY OF THE INVENTION

An object of the present invention is to provide a wood type golf club head having lower center of gravity, and capable of obtaining an accurate directivity of a driven ball and a maximum distance of flight thereof by setting a sweet spot in the central portion of the front face of the club head.

Another object of the present invention is to provide a wood type golf club head to which full swing can be given easily by lowering the center of gravity of the club head with its weight in a well balanced manner without using a weight member.

To achieve these objects, the present invention provides a wood type golf club head having a crown portion in an upper part of a club bead body, a sole in a lower part thereof, a face in a front side thereof, a side portion between the crown portion and sole, and a continuous ridgeline extending from a toe side to a heel side along a boundary between the crown portion and side portion, characterized in that a height of a portion of the ridgeline on a rear side, measured from the sole, is lower than ¼ of that of the club head, a height of a portion of the ridgeline on a heel side, measured from the sole, being higher than ½ of that of the club head, remaining portions of the ridgeline, measured from the sole, being set ¼–½ of that of the club head with the total length of the remaining portions of the ridgeline accounting for 60–90% of a total length thereof.

The height, measured from the sole of a wood type golf club head, of the ridgeline thereof as a whole is set small in this manner. However, since the heights of predetermined portions of this ridgeline which correspond to various circumferential portions of the club head are thus set less than ¼, between ¼ and ½, and more than ½ of that of the club head and the portions are set from the toe side to the heal side properly, it becomes possible to control the weight ratio of the club head easily, and set the center of gravity thereof to a low position and a sweet spot in the central portion of the face.

Namely, the length of a ridgeline portion the height of which is ¼–½ of that of the club head is set to 60–90% of a total length of the ridgeline extending from the toe side to the heel side, a ridgeline portion which is lower than ¼ of that of the club head being provided on a region of 40–80% of a total length of the ridgeline measuring from the toe side, a ridgeline portion which is higher than ½ of that of the club head being provided on a region of 80–100% of a total length of the ridgeline measuring from the toe side. Consequently, it becomes possible to easily control the weight ratio of the club head in the direction of the height thereof, and set a sweet spot in the central portion of the front face. Accordingly, setting the center of gravity of the club head lower, a sweet spot can be set in the central portion of the face, so that by hitting a ball with the sweet spot the direction of a driven ball can be stabilized, and a maximum distance of flight of a ball can be obtained.

Since the center of gravity of the club head is set lower by regulating the height of the ridgeline, the use of a weight member can be omitted, and this enables the weight of the club head to be balanced well, and smooth full swing to be given to the club head easily.

DESCRIPTION OF PREFERRED EMBODIMENT

Figure 1:
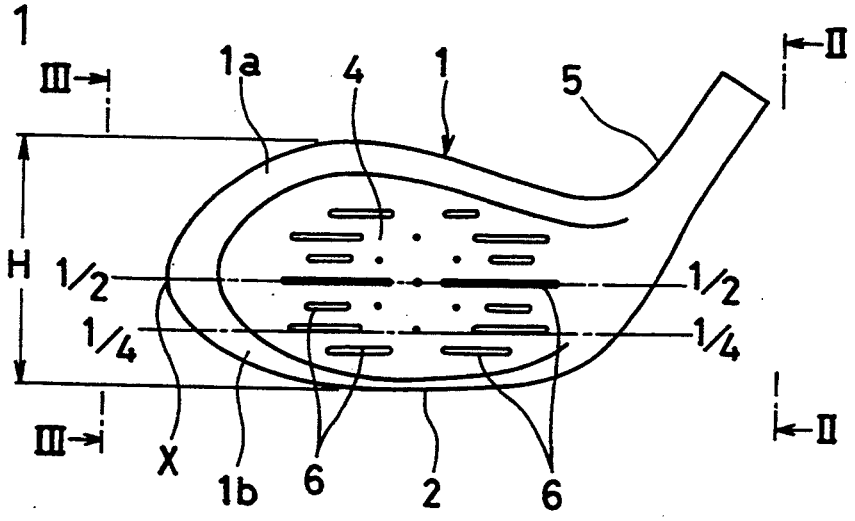
FIG. 1 is a front view of the wood type golf club head according to the present invention.
Figure 2:
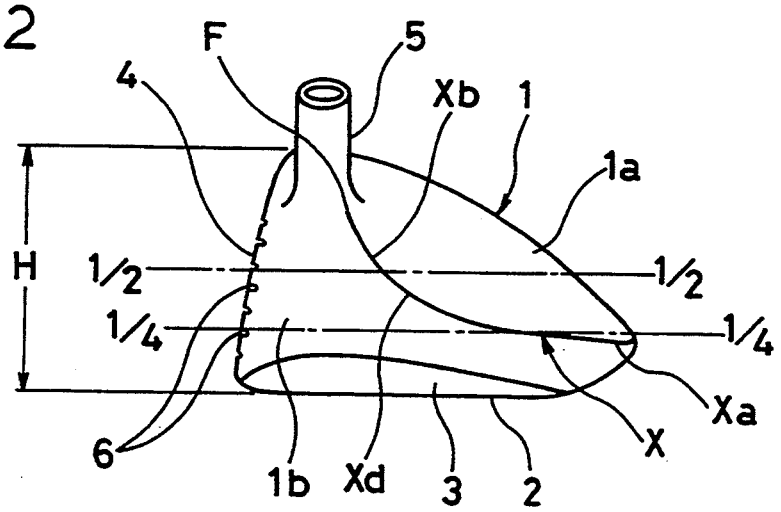
FIG. 2 is a side view taken along the line II—II and in the direction of the arrows drawn therewith in FIG. 1.
Figure 3:
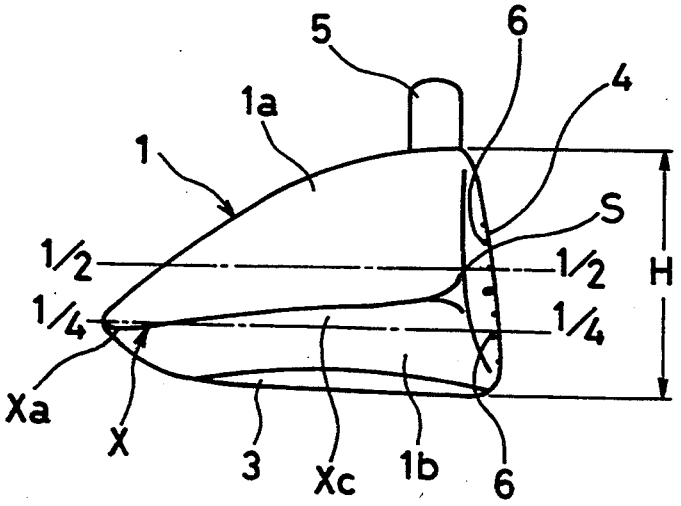
FIG. 3 is a side view taken along the line III—III and in the direction of the arrows drawn therewith in FIG. 1.
Figure 4:
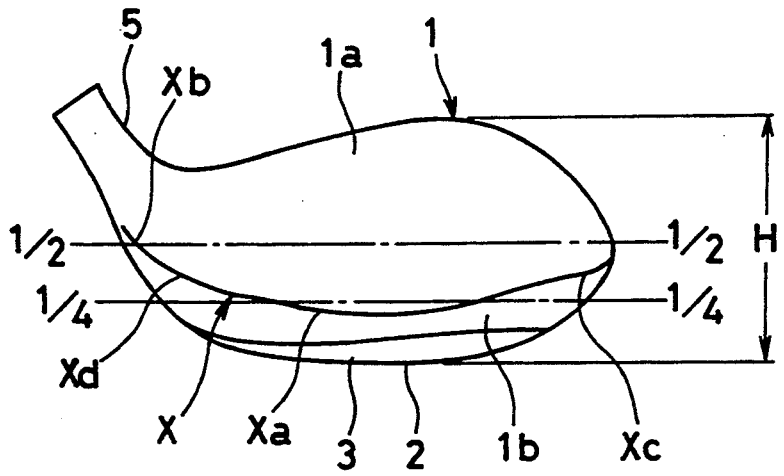
FIG. 4 is a rear view of the club head of FIG. 1.
Figure 5:
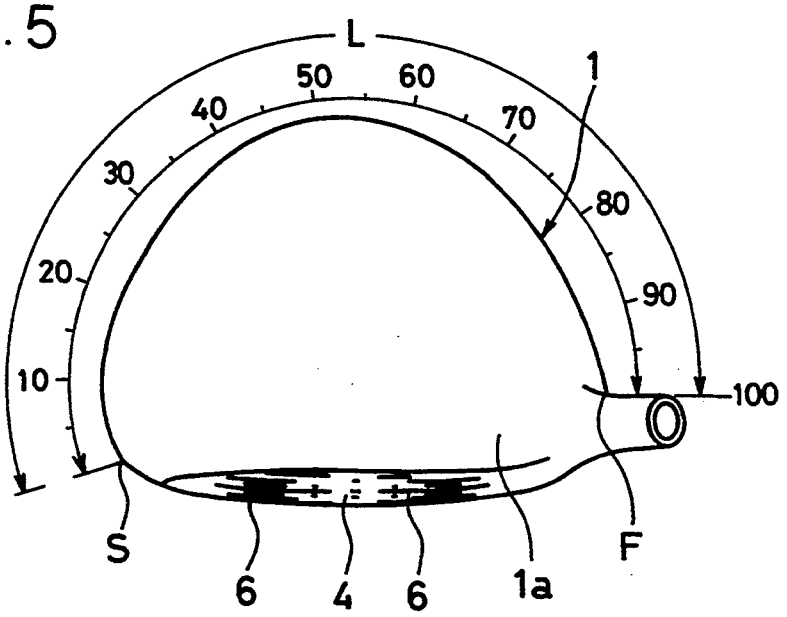
FIG. 5 illustrates the ranges of heights of a ridgeline in a plan view of FIG. 1
Figure 6:
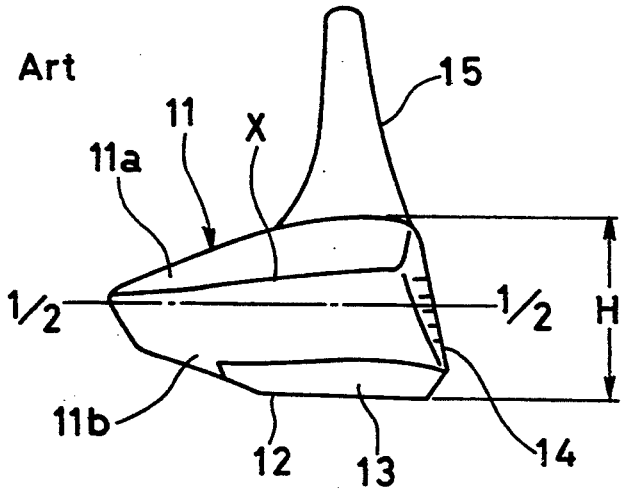
FIG. 6 Prior Art
FIG. 6 is a side view of a conventional wood type golf club head.

As shown in FIGS. 1–4, the wood type golf club head 1 according to the present invention is formed so that it has a crown portion 1*a* in an upper part thereof, a sole 2 in a lower part thereof, a ball—striking face 4 in a front side thereof, and a shaft connecting hosel 5 in a heel side of thereof. A sole plate 3 is fixed to the sole 2, and groove type score lines 6 are formed on the face 4. The club head 1 is also provided with a side portion 1*b* having of an inclined surface between the crown portion 1*a* and sole 2, and a continuous ridgeline X extending from the toe side to the heel side via a rear side of the club head along a boundary between the side portion 1*b* and crown portion 1*a*.

In the above-described structure, the height of the ridgeline X measured from the sole 2 in the wood type golf club head according to the present invention varies from the toe side to the heel side. A continuous ridgeline portion Xa on the rear side of the club head is formed on a region of a height in the range of levels less than $\frac{1}{4}$ of the height H of the club head 1, and a continuous ridgeline portion Xb on the heel side, at which the hosel 5 is provided, of the club head 1 on a region of a height in the range of levels more than $\frac{1}{2}$ of the height H of the club head 1, the remaining ridgeline portion (a continuous ridgeline portion Xc on the toe side plus a continuous ridgeline portion Xd between the rear side and heel side of the club head) being formed on a region of a height in the range of levels $\frac{1}{4}$–$\frac{1}{2}$ of the height H of the club head 1. The total length of the last-mentioned ridgeline portions Xc, Xd combined is set to 60–90% of a total length of the whole ridgeline X. When the length of the ridgeline portions Xc, Xd combined is less than 60% of a total length of the ridgeline, it becomes impossible to lower the center of gravity of the club head to such a satisfactory extent that enables a sweet spot to be set in the central portion of the face thereof by controlling the weight ratio of the club head 1. When the length of the same ridgeline portions exceeds 90%, the center of gravity of the club head becomes too low, and a sweet spot is positioned in a lower portion of the face.

According to the present invention, the ridgeline X on the wood type golf club head 1 is thus formed so that it comprises a ridgeline portion Xa having the height which is less than $\frac{1}{4}$ of that H of the club head 1, a ridgeline portion Xb having the height which is more than $\frac{1}{2}$ of that H of the club head 1, and ridgeline portions Xc, Xd having the height which is in the range of $\frac{1}{4}$–$\frac{1}{3}$ of that H of the club head, and these ridge-line portions are arranged on the rear side, heel side and toe side respectively of the club head. This enables the weight ratio of the club head 1 in the widthwise direction thereof from the heel side to the toe side thereof to be controlled easily, and the center of gravity of the club head 1 in the widthwise direction thereof to be set in the central portion thereof. The length of the ridgeline portion having the height of $\frac{1}{4}$–$\frac{1}{2}$ of that H of the club head 1 is set to 60–90% of a total length of the ridgeline, and a low ridgeline portion of the height which is less than $\frac{1}{4}$ of that H of the club head is formed on a region of 40–80% of a total length of the ridgeline measured from the toe side, i.e., in a region corresponding to the rear side of the club head. Accordingly, the controlling of the weight ratio of the club head in the direction of the height thereof can be done easily, and a sweet spot defined as a point at which a line drawn from the center of gravity of the club head perpendicularly to the face thereof crosses the face can be set in the central portion of the face. Consequently, setting the center of gravity of the club head lower, a sweet spot can be set in the central portion of the face. Also, the direction of a ball driven with the sweet spot utilized as a meeting spot can be stabilized, and a maximum distance of flight of a ball can be obtained.

Since the center of gravity of the club head is set lower by regulating the height of the ridgeline, the use of a weight member can be omitted. This enables the occurrence of imbalance of the weight of the club head to be prevented, and smooth full swing to be given easily.

In the above-described embodiment, the length of the ridgeline portion Xa provided on the region of the height which is less than $\frac{1}{4}$ of that H of the club head 1 may preferably be set to 5–35% of a total length L of the whole ridgeline X. If the starting point S of the ridgeline X is on the toe side with the terminating point F thereof on the heel side, this ridgeline portion Xa is preferably in a region of 40–80% of a total length L of the ridgeline measured from the starting point S.

The length of the ridgeline portion Xb having the height which is more than $\frac{1}{2}$ of that H of the club head is preferably set to 5–20% of a total length L of the whole ridgeline X, and provided in a region of 80–100% of a total length L of the ridgeline extending from the starting point S. This enables the balancing of the weight referred to above and the setting of a sweet spot to be done easily. Moreover, the wall thickness of a joint portion at which the body of the club head 1 and the club shaft-connecting hosel 5 are connected together increases to reinforce the hosel 5, and the ball hitting feeling can be improved.

According to the present invention, the position of the center of gravity of the club head 1 is determined in the following manner.

A club head with its face downward is put on a vertically-stood support and when the club head is balanced thereon, a contact point of the face contacting with the support is sought. A contact point of a sole is sought as well in the same manner. Each straight line is drawn along a direction of extending the support, passing through the two points. And a crossing point of the two is determined as the center of gravity.

According to the present invention described above, the ridgeline portion Xa on the rear side is provided on the region of the height which is less than $\frac{1}{4}$ of that of the club head, the ridgeline portion Xb on the heel side being provided on the region having the height which is more than $\frac{1}{2}$ of that of the club head, the remaining ridgeline portion Xc, Xd being provided on the region of the height which is $\frac{1}{4}$–$\frac{1}{2}$ of that of the club head and the total length of the last-mentioned ridgeline portions Xc, Xd accounts for 60–90% of a total length of the ridgeline. This enables the weight ratio of the club head to be controlled easily, the center of gravity of the club head to be lowered, and a sweet spot to be set in the central portion of the face of the club head. Therefore, by hitting a ball with the sweet spot, the direction of flying a ball can be stabilized, and a maximum distance of flight of a ball can be obtained.

Since the center of gravity of the club head is set lower by regulating the height of the ridgeline, the use of a separately prepared weight member can be omitted. This enables the weight of the club head to be balanced, and smooth full swing to be given easily.

What is claimed is:

1. A wood type golf club head having a crown portion in an upper part of a club head body, a sole in a lower part thereof, a face in a front side thereof, a side portion between said crown portion and said sole, and a continuous ridgeline extending from a toe side to a heel side along a boundary between said crown portion and said side portion, characterized in that:

the height of a portion of said ridgeline on a rear side, measured from said sole, is set less than $\frac{1}{4}$ of that of said club head, the height of a portion of said ridgeline on the heel side, measured from said sole, being set more than $\frac{1}{2}$ of that of said club head, the height of remaining portions of said ridgeline, measured from said sole, being set $\frac{1}{4}$–$\frac{1}{2}$ of that of said club head with the total length of the last-mentioned portions of said ridgeline accounting for 60–90% of a total length thereof.

2. A wood type golf club head according to claim 1, wherein said ridgeline portion having the height which is set lees than $\frac{1}{4}$ of that of said club head is provided on a region of 40–80% of a total length of said ridgeline measured from said toe side, in such a manner that the length of said ridgeline portion accounts for 5–35% of a total length of said ridgeline.

3. A wood type golf club head according to claim 2, wherein a sweet spot is formed in a central portion of said face.

4. A wood type golf club head according to claim 1, wherein said ridgeline portion of the height which is set more than $\frac{1}{2}$ of that of said club head is provided on a region of 80–100% of a total length of said ridgeline extending from said toe side, in such a manner that the length of said ridgeline portion accounts for 5–20% of a total length of said ridgeline.

5. A wood type golf club head according to claim 4, wherein a sweet spot is formed in a central portion of said face.

* * * * *